US005473995A

United States Patent [19]

Gottlieb

[11] Patent Number: 5,473,995

[45] Date of Patent: Dec. 12, 1995

[54] PALLET TOP MADE OF CORRUGATE

[75] Inventor: Norman J. Gottlieb, Thornhill, Canada

[73] Assignee: Container Corporation International, Inc., Barbados, Wis.

[21] Appl. No.: 246,858

[22] Filed: May 20, 1994

[51] Int. Cl.[6] ..... B65D 19/00

[52] U.S. Cl. ..... 108/51.3; 108/55.1

[58] Field of Search ..... 108/51.1, 151.3, 108/56.1, 55.1, 56.3, 55.3; 206/386, 597, 600

[56] References Cited

U.S. PATENT DOCUMENTS

| | | | |
|---|---|---|---|
| 2,576,715 | 11/1951 | Farrell | 108/55.1 X |
| 2,906,481 | 9/1959 | Parker | 108/56.1 X |
| 2,928,578 | 3/1960 | Parker | 108/55.1 X |
| 3,913,154 | 10/1975 | Sweeney | 108/51.3 X |
| 3,934,805 | 1/1976 | Elaschuk | 108/51.3 X |
| 3,952,672 | 4/1976 | Gordon et al. | 108/51.3 |
| 4,390,154 | 6/1983 | Ostler et al. | 108/51.3 X |
| 4,399,972 | 8/1983 | McCulloch | 108/51.3 X |
| 4,467,004 | 8/1984 | Liebel | 108/51.3 X |
| 4,771,885 | 9/1988 | Linnemann | 206/386 |
| 4,798,294 | 1/1989 | Bodi | 206/600 |
| 4,863,024 | 9/1989 | Booth | 108/56.3 X |

FOREIGN PATENT DOCUMENTS

| | | | |
|---|---|---|---|
| 2495109 | 6/1982 | France | 206/599 |

*Primary Examiner*—Kenneth J. Dorner
*Assistant Examiner*—Janet M. Wilkens
*Attorney, Agent, or Firm*—Lynn C. Schumacher; Dowell & Dowell

[57] ABSTRACT

The present invention provides a pallet top constructed entirely of corrugated cardboard. In one aspect the pallet top includes a thick corrugate center panel and thick corrugate reinforcing edge pieces glued along the periphery of the center panel. The corrugate reinforcing edge pieces and the corrugate center panel are arranged so that the fluting of the edge pieces run perpendicular to the direction in which the fluting in the center panel runs thereby significantly increasing the strength of the resulting pallet top. A corrugated wrap sheet is provided having folding flaps along the edges thereof. The flaps are folded over the reinforcing edge pieces and glued to the top surface of the edge pieces. In another aspect the corrugate reinforcing edge pieces are tubes of rectangular cross section formed along the periphery of the center panel.

2 Claims, 6 Drawing Sheets

PALLET TOP MADE OF CORRUGATE

FIELD OF THE INVENTION

The present invention relates to pallet tops fabricated of cardboard corrugate.

BACKGROUND OF THE INVENTION

Pallets are used extensively for shipping items in bulk and are generally made of wood. In some cases the pallet comprises a wooden skid and the items to be shipped are stacked on top of the skid and held in place by plastic or metal straps. In order to stabilize and secure the load on the pallet skid a pallet top is utilized which rests on the top of the load and secured there by strapping tightly wrapped about the whole assembly. The pallet tops also provide a surface on which another skid may be placed.

Known pallet tops usually comprise a wooden frame made of four thin pieces of wood joined to form a rectangular frame. Four metal plate brackets are provided with each bracket overlapping the adjacent ends of two pieces of wood and are secured to the wood with screws or nails.

The wooden pallet tops are generally constructed as a frame in order to provide a step portion along the inner perimeter of the frame. This provides a surface against which the arms of an automated pallet top remover abut in order to remove the pallet top from the load. An advantage of having no center portion is that it minimizes the weight and cost of the wooden frame.

There are several drawbacks to this type of pallet top. The lack of a central portion is a drawback with loads comprising small items in high volume. This is particularly problematic for loads comprising small items such as bottles and the like which are prone to wobbling as the skids are being moved about. Wooden frame pallet tops are prone to splitting and breaking when in place on the pallet due to the very high stresses on the frames developed by the securing straps. Splitting of the frames is also a frequent occurrence due to the stresses developed because of the weight of the next pallet stacked on the low surface area wooden frame.

Further, the wooden frame pallet tops are inconvenient to handle and may pose an accident risk due to both the weight of the wood and the danger of slivers or splinters. The wood components can easily become dirty due to outside storage and may also harbour larvae, microbes, bacteria, termites and the like which are problematic in for example the food industry. Certain countries presently by law require special steam treatment of wood pallets prior to entry from a foreign country thereby increasing the expense of shipping. These pallet tops are expensive to make due to the increasing cost of wood and are expensive to recycle since they are made of wood and metal.

Therefore it would be advantageous to provide a new pallet top which is strong and lightweight; has a filled center portion for increased load stability to provide a higher surface area on which a stacked pallet may rest; and can withstand the high stresses which are developed when the securing straps are in place. It would also be advantageous for this new pallet top to be inexpensive, recyclable and not pose an accident threat when being handled.

SUMMARY OF THE INVENTION

The present invention provides a pallet top comprising a corrugate panel member having a bottom surface and a top surface with peripheral edges with the corrugate panel member including fluting extending in one direction thereacross. Each peripheral edge on the top surface has an elongate corrugate member contiguous therewith and attached thereto. Each elongate corrugate member is provided with fluting, wherein the fluting of each elongate corrugate member is oriented substantially perpendicular to the direction in which the fluting of the corrugate panel member extends.

BRIEF DESCRIPTION OF THE DRAWINGS

The pallet top constructed in accordance with the present invention will now be described, by way of example only, reference being had to the accompanying,drawings, in which.

DETAILED DESCRIPTION OF THE INVENTION

Figure 1:
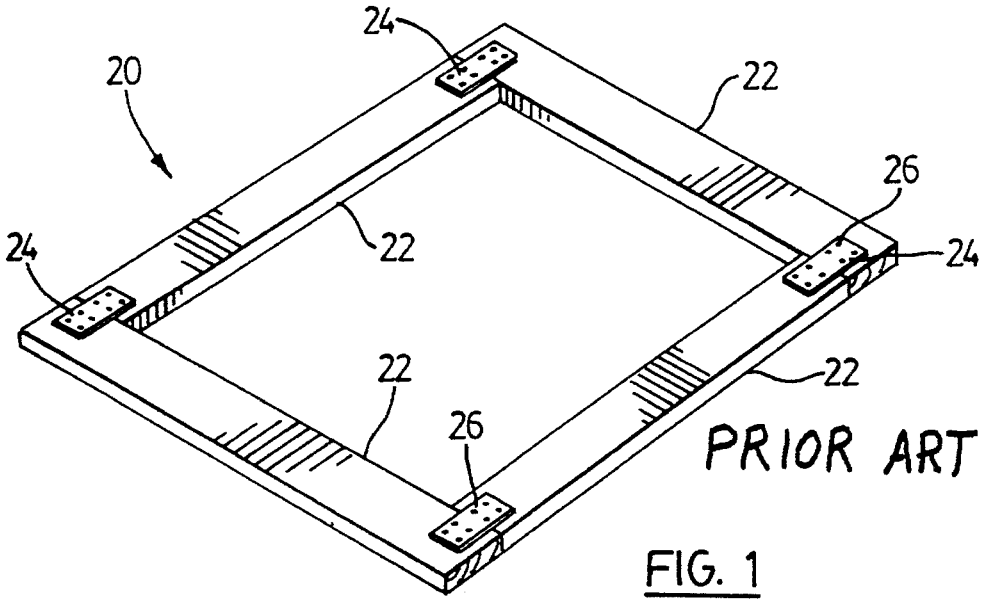
FIG. 1 is a perspective view of a prior art pallet top.

Referring first to FIG. 1, a prior art pallet top is shown generally at 20 and includes four pieces of wood 22 joined at the ends thereof by metal brackets 24 overlapping the end portions of each piece of wood 22 at the corners. Nails or screws 26 are used to secure brackets 24 to the pieces of wood 22. Pallet top 20 is mounted onto the top of a stack of goods loaded onto a pallet bottom or skid (not shown) and secured there by metal or plastic strapping wrapped about the stack. Pallet top 20 serves as a platform for other pallets stacked thereon. As mentioned previously, this type of pallet top constructed of wood is prone to splitting and breaking due to the high stresses developed when the wooden frame is held in place by the strapping.

Figure 2:
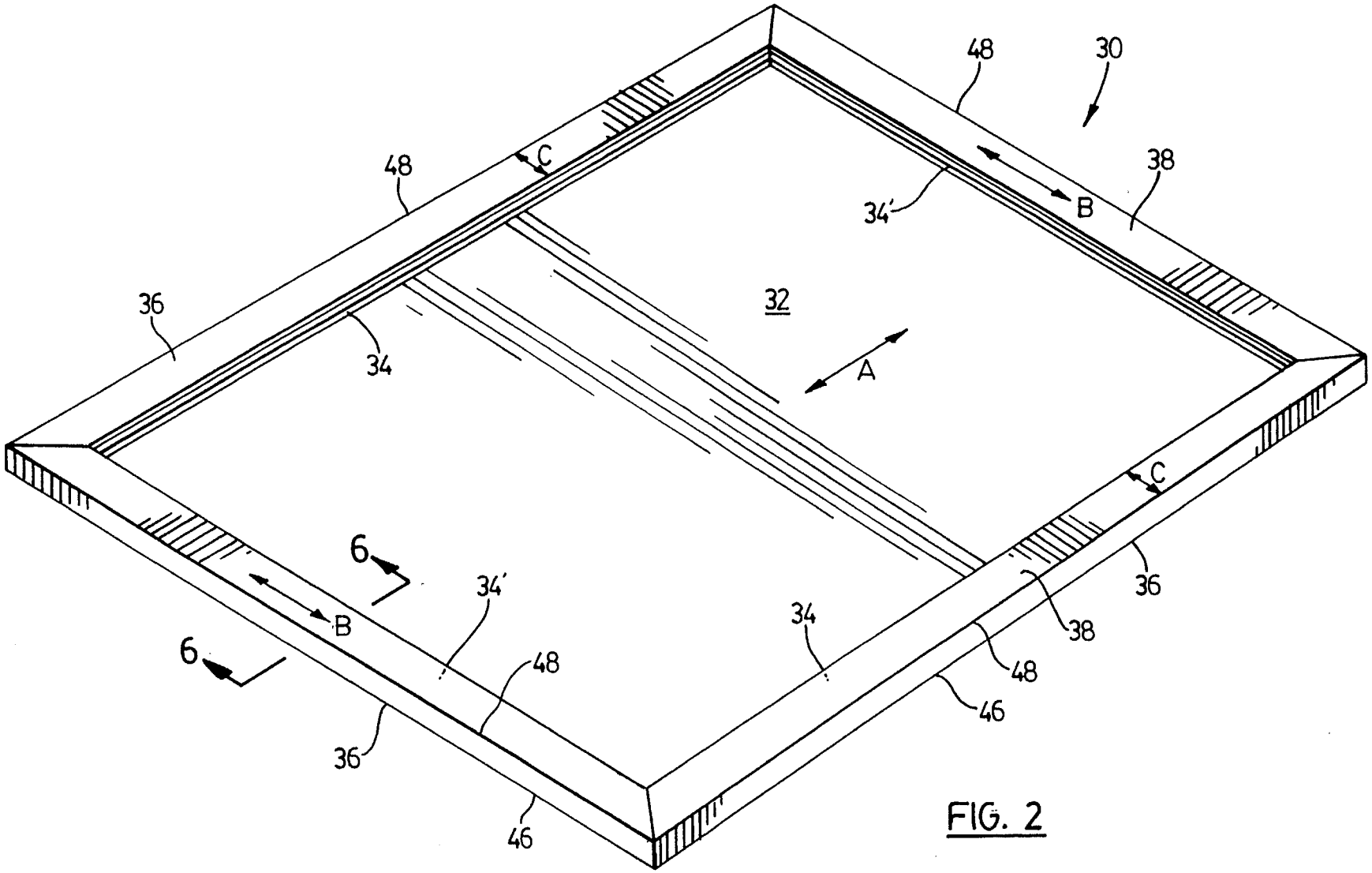
FIG. 2 is a perspective view of a pallet top constructed in accordance with the present invention.

Referring now to FIG. 2, a pallet top constructed in accordance with the present invention is shown assembled at 30 and includes a central planar panel 32, two reinforcing edge pieces 34 positioned along and glued to opposed peripheral edges of central panel 32 and two other elongate, reinforcing edge pieces or members 34' positioned along and glued to the other two opposed peripheral edges of panel 32. The difference between reinforcing edge pieces 34 and 34' will be discussed below. Central panel 32 and reinforcing edge pieces 34,34' are made of cardboard corrugate.

Pallet top 30 is provided with a cardboard outer wrap sheet 36 having edge portions or flaps 38 folded over and glued to the top surface of edge pieces 34,34'. Cover 36 preferably fabricated of corrugate and improves the flexural strength of the pallet top. However, a significant increase in the structural strength of pallet top 30 is due to central panel 32 and reinforcing edge pieces 34,34' being arranged so that the fluting of each are perpendicular.

Figure 3:
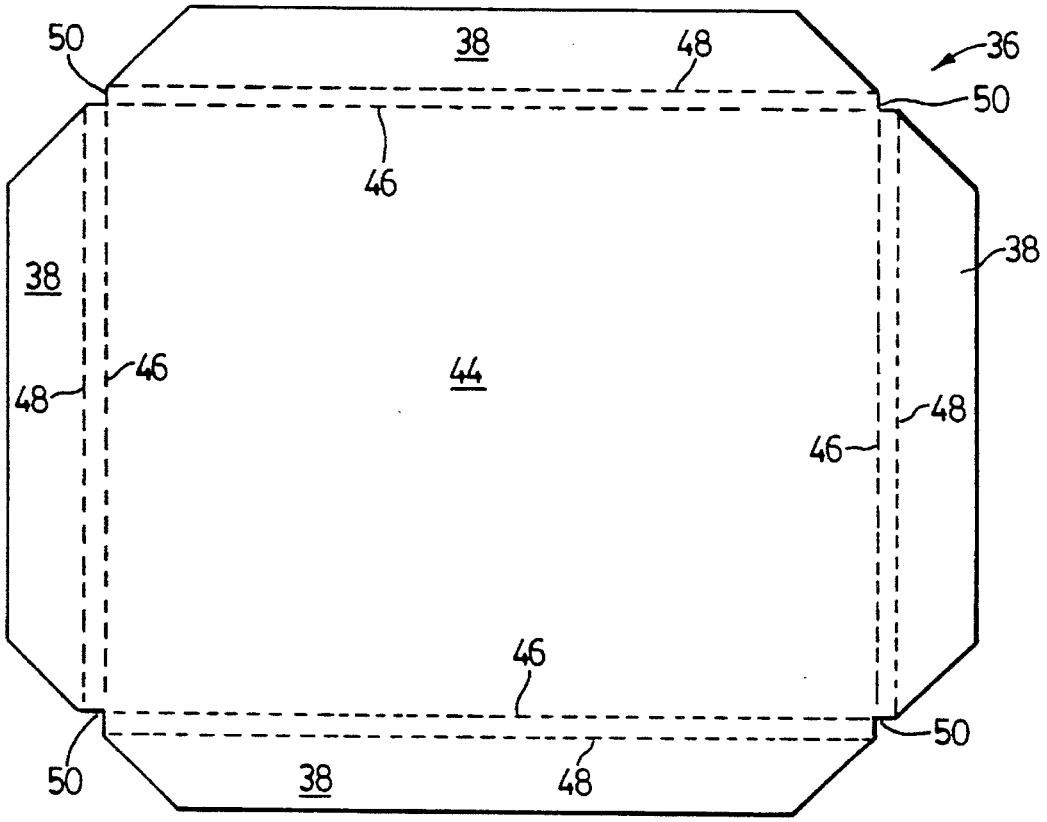
FIG. 3 is a plan view of a blank of a wrap sheet of the pallet top shown in FIG. 2.

FIG. 3 shows outer wrap sheet 36 as a die cut blank and comprises a central rectangular portion 44 with flaps 38 having mitred corners as shown. Flaps 38 fold with respect to central portion 44 along parallel, spaced fold or crease lines 46 and 48. The spacing between crease lines 46 and 48 is predetermined depending on the thickness of central panel 32 and reinforcing edge pieces 34. A triangular cut-out section 50 is located at each corner with the sides of the triangle being equal to the spacing between crease lines 46 and 48.

Figure 4:
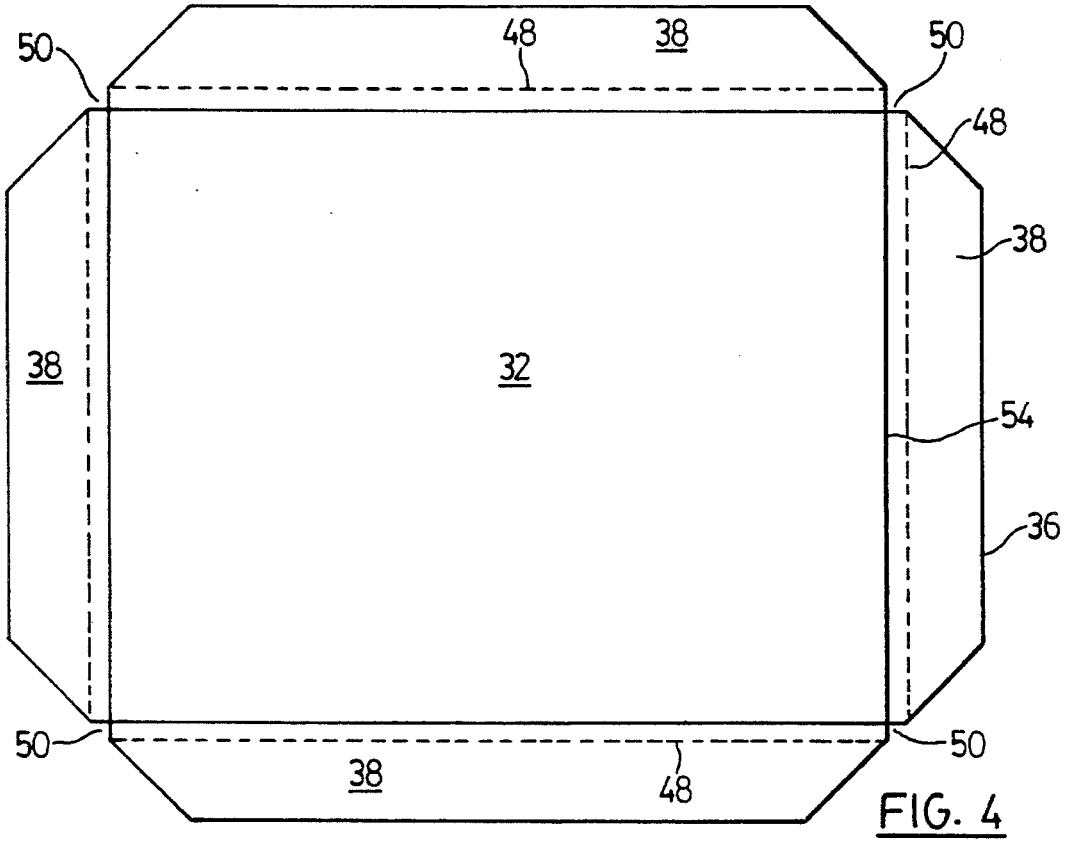
FIG. 4 is similar to FIG. 3 but includes with a corrugate central section centred on the blank.
Figure 5:
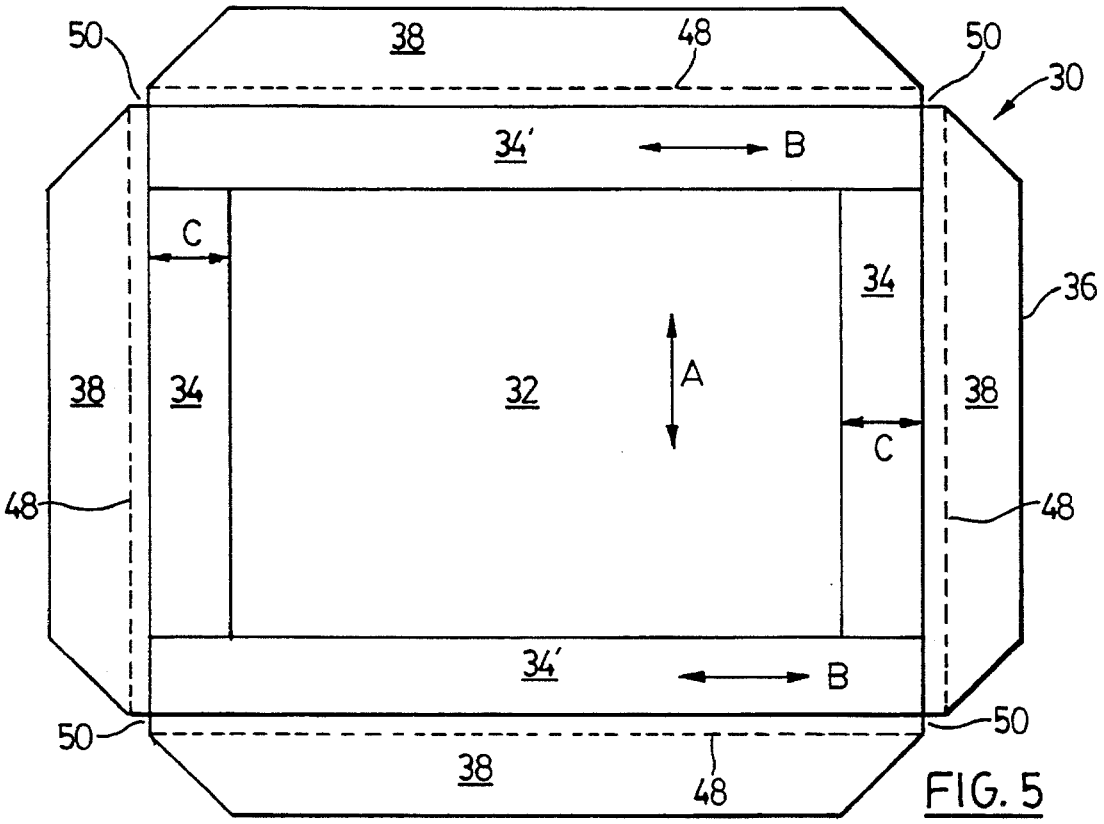
FIG. 5 is a plan view of the partially assembled pallet top of FIG. 4 with reinforcing side members extending around the periphery of the central section.

In FIG. 4 central planar panel 32 is shown contiguous or adjacent to central portion 44 with edges 54 of panel 32 aligned with crease lines 46 (not shown). FIG. 5 shows edge pieces 34,34' extending along the peripheral edges of central panel 32. Central panel 32 may be glued to wrap sheet 36 and edge pieces 34,34' are glued to the edges of central panel 32. Flaps 38 are folded along fold lines 46 and 48 to cover over the top surface of edge pieces 34,34' and flaps 38 are glued to the pieces 34,34'. Flaps 38 are cut sufficiently wide to completely cover reinforcing edge pieces 34,34'. The spacing of crease lines 46 and 48, the mitring of the ends of flaps 38 and the dimensions of cut-out sections 50 are chosen to ensure square edges when pallet top 30 is assembled.

Figure 6:
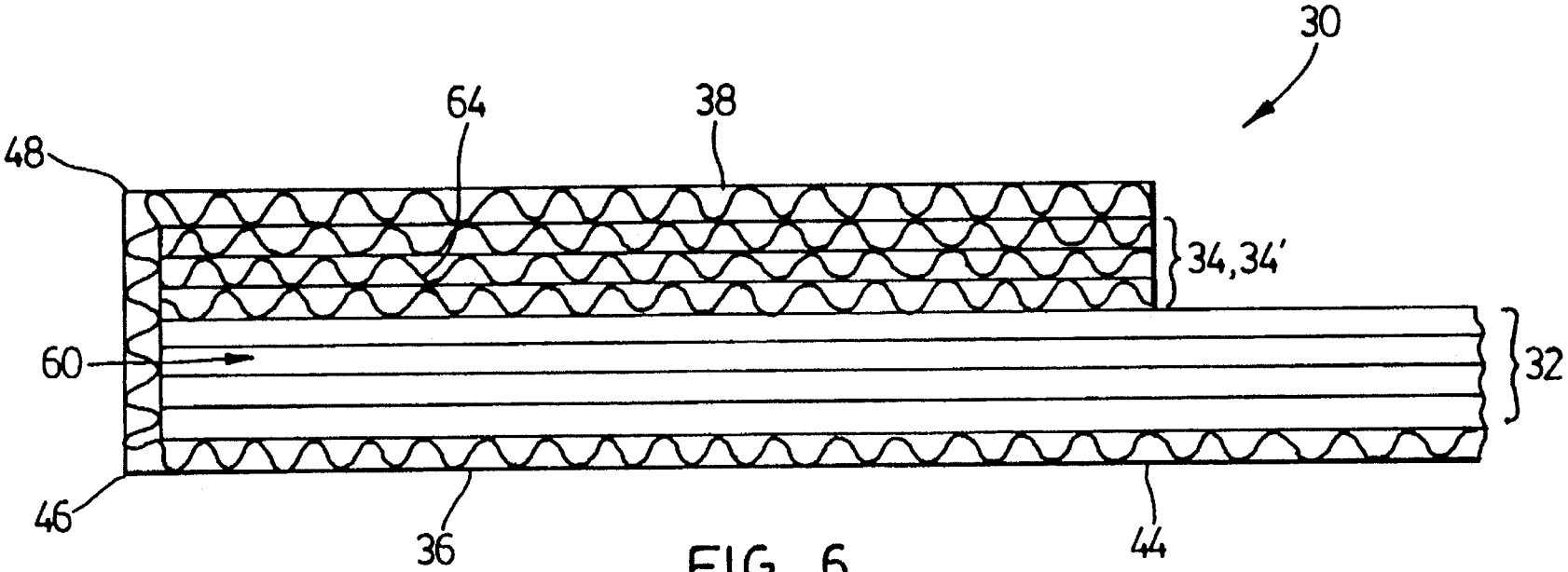
FIG. 6 is a sectional view, taken along line 6—6 of FIG. 2.

The cross sectional view of FIG. 6 illustrates the relative orientation of the fluting of the corrugate of central panel 32 shown by arrow 60 and the direction of fluting 64 of edge pieces 34,34' at each side or end portion of pallet top 30. Specifically, the fluting of reinforcing edge pieces 34,34' along the peripheral edges of central panel 32 extends perpendicular to the fluting of the central panel. Thus, pallet top 30 will comprise two reinforcing edge pieces with the fluting running along the length of the edge piece and two edge pieces with fluting extending transversely across the width thereof. For example, with reference to FIGS. 2 and 5, if the fluting of central panel 32 extends in the direction of arrow A, then the fluting of edge pieces 34' extends along the length of the piece in the direction of arrow B and the fluting of edge pieces 34 extends across the width thereof in the direction of arrow C.

Elongate, reinforcing edge pieces 34,34' are shown in FIG. 6 comprising triple walled corrugate and central panel 32 comprising quadruple walled corrugate, but there may be more or fewer layers of corrugate depending on the application for the pallet top. If high stresses are anticipated then panel 32 and reinforcing edge pieces 34,34' would have more layers of fluting to give greater strength to the pallet top.

Referring to FIG. 2, the interior step along the inner perimeter of elongate reinforcing members 34,34' provides a surface against which the arms of an automated pallet top remover may abut for placing on or removing the pallet top from the load.

Pallet top 30 is advantageous over previous pallet tops for several reasons. The most significant advantage is the unexpectedly high strength of the corrugate pallet top compared to the wooden frames. Arranging the fluting in the reinforcing edge pieces 34,34' to extend perpendicular to the fluting in central panel 32 in the pallet top 30 of FIG. 2 results in a very high strength pallet top having superior structural properties compared to the wooden frames of FIG. 1. Pallet top 30 is not prone to cracking or splitting as is pallet top 20. Wrap sheet 36 increases the flexural strength of the pallet top when square edges are obtained. Wrap sheet 36 also acts to protect the fluting of the central panel 32 and reinforcing members 34, 34' from being ripped or torn by the strapping.

The pallet top with the central panel 32 acts to stabilize loads comprising small items and provides a more stable surface on which other pallets may be loaded. It has also been observed that for example when plastic bottles are loaded on the pallet, there is a much reduced incidence of bottles along the top edges of the load being damaged or crushed as is routinely observed with the wooden frame pallet tops.

Further, because pallet top 30 is constructed entirely of cardboard corrugate it is more economical to produce than the wooden frames and may be more readily and economically discarded or recycled. It is much lighter than wooden frame pallet tops and therefore poses a much lower health threat compared to the wooden frames. The corrugated cardboard is more hygienic than wooden frame tops because the corrugate is heated as part of the fabrication process and so is usually free of harmful microbes and the like.

Figure 7:
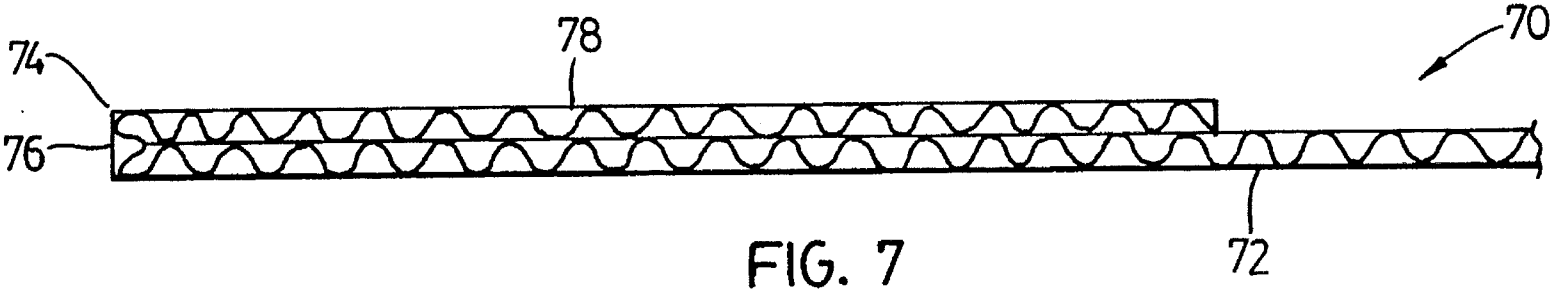
FIG. 7 is a sectional view, broken away, of a second embodiment of a pallet top constructed in accordance with the present invention.

FIG. 7 shows a second embodiment of a pallet top at 70 constructed in accordance with the present invention. Pallet top 70 is a unitary piece of corrugate comprising a planar corrugate sheet 72 having edges 74 folded along creases 76 to produce a flap 78. While shown as single walled corrugate in FIG. 7, pallet top 70 is preferably constructed of heavy corrugated cardboard such as triple walled corrugate for strength. It is important that the fold creases or edges 76 be square in order to realize the increased flexural strength of the pallet top.

Figures 8, 10:
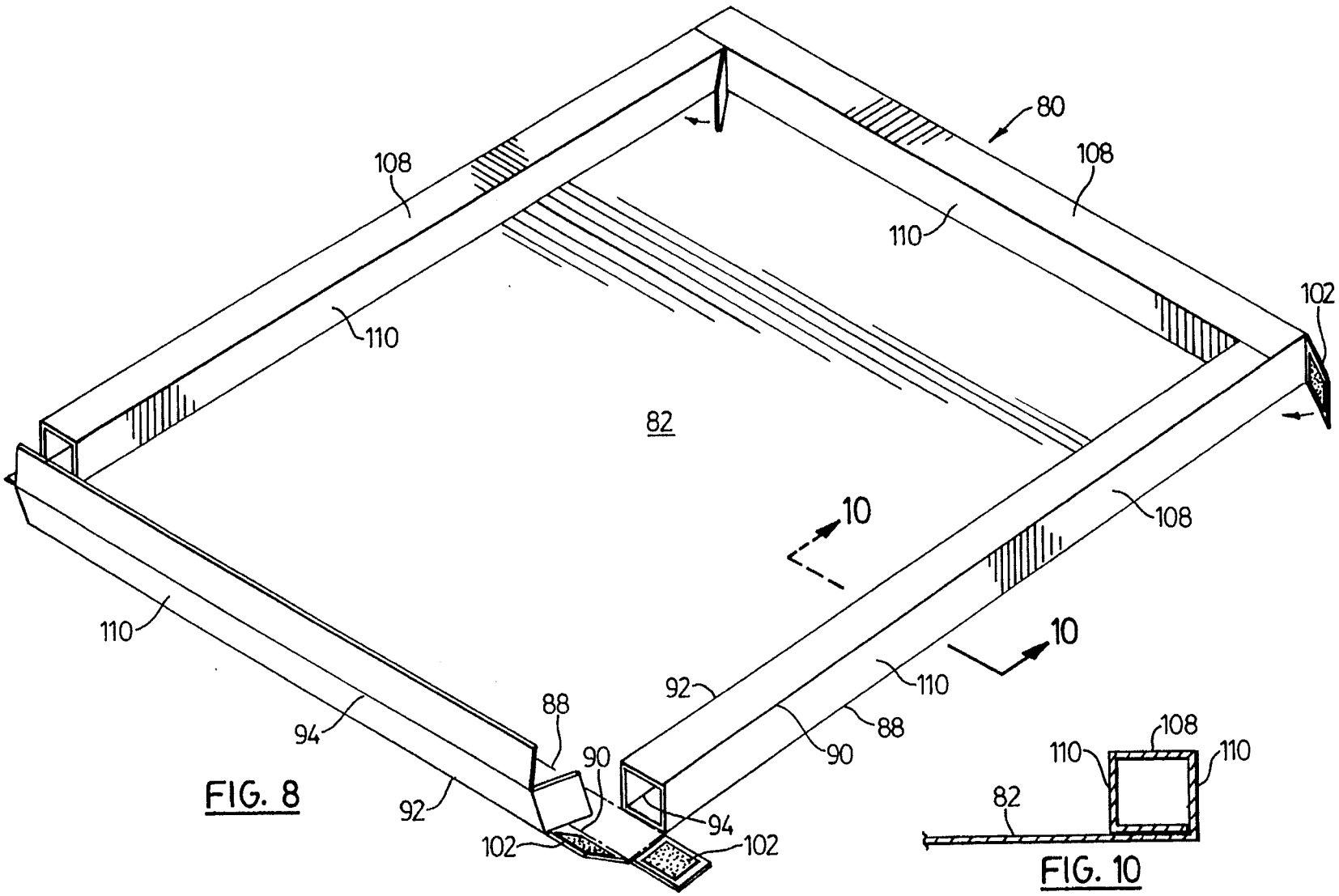
FIG. 8 is a perspective view of a third embodiment of a pallet top according to the present invention.
FIG. 10 is a sectional view along line 10—10 of FIG. 8.
Figure 9:
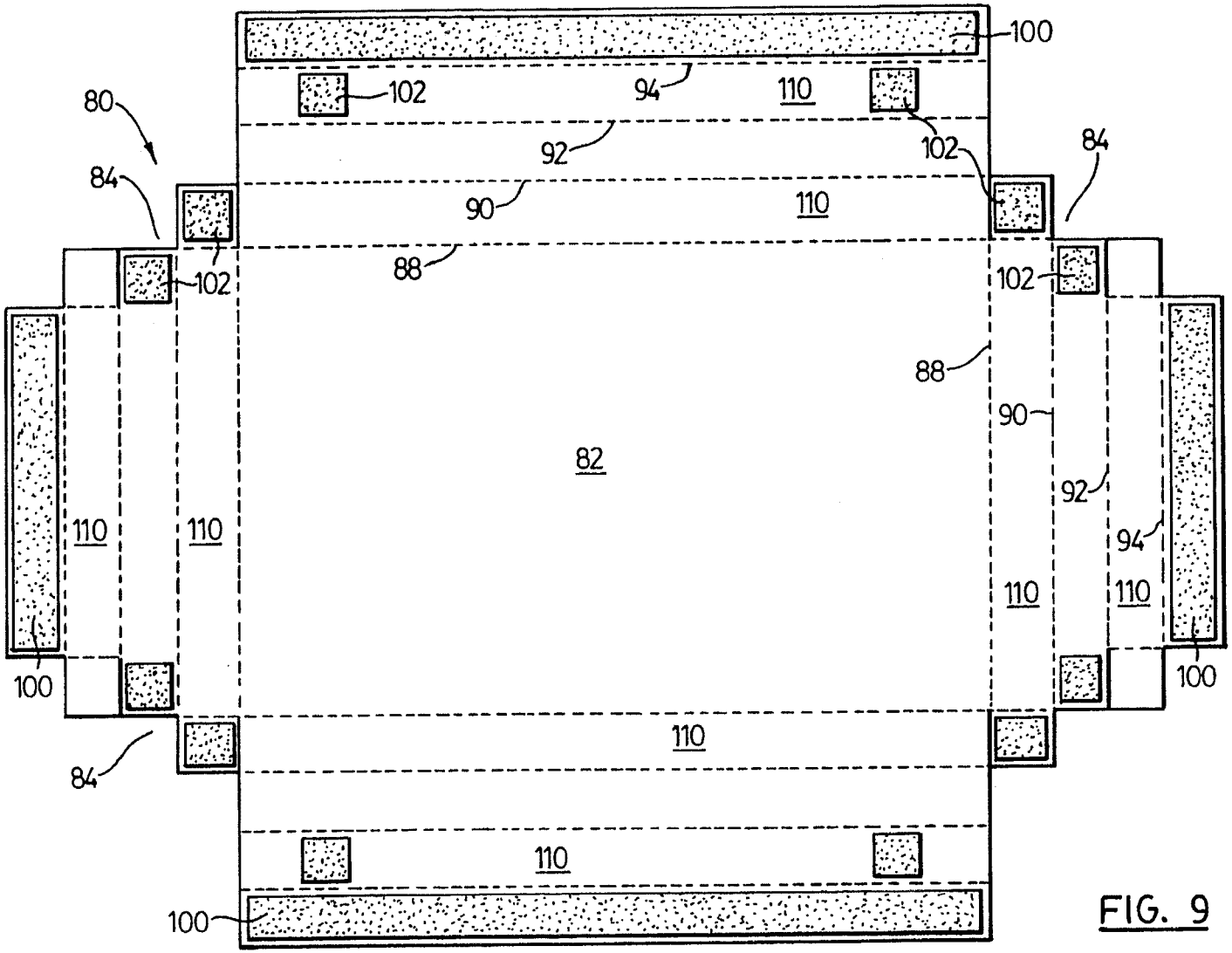
FIG. 9 is a plan view of the blank of the pallet top shown in FIG. 8.

A third embodiment of a pallet top is shown at 80 in FIG. 8 partially assembled from the blank in FIG. 9. Pallet top 80 comprises a planar corrugate sheet with a central section 82 and edge portions 84 provided with creases to give several flaps. When assembled, the blank of FIG. 9 is folded along crease lines 88, 90, 92 and 94 and glued to give reinforced edge members or runners 108 having a square cross section as shown in FIG. 10. Each elongate runner includes two spaced, parallel flaps 110. Glue patches 100 are used to glue appropriate flaps of the runners to the top portion of central section 82 and patches 102 are employed to glue flaps on one runner to the adjacent runners. When assembled pallet top 80 has rectangular tubes 108 extending along each of the edges thereof having two parallel and spaced sections 110 each perpendicular to central section 82.

The presence of two spaced sections 110 oriented perpendicular to central section 82 along the peripheral edges of pallet top 80 act to reinforce the peripheral edges of the pallet top thereby significantly increasing the resistance of the pallet top to bending and warping.

While the pallet top constructed in accordance with the present invention has been described and illustrated with respect to the preferred and alternative embodiments, it will be appreciated by those skilled in the art that numerous other embodiments of the pallet top may be made without departing from the scope of the invention disclosed herein.

Therefore what is claimed is:

1. A pallet top, comprising:

a) a corrugate panel member having a bottom surface and a top surface with peripheral edges, the corrugate panel member having fluting extending in one direction therethrough;

b) each peripheral edge on said top surface having an elongate corrugate member attached thereto, each elongate corrugate member having fluting, wherein the fluting of each elongate corrugate member is oriented substantially perpendicular to the direction in which the fluting of said corrugate panel member extends; and c) a wrap sheet having a central portion with edges, wherein the central portion is contiguous with the bottom surface of said corrugate panel member, the wrap sheet including an integral flap member along each edge of the central portion, each elongate corrugate member including a top surface, wherein the flap members are folded over said top surface and secured thereto.

2. The pallet top according to claim 1 wherein said wrap sheet is formed from corrugate.

* * * * *